US005165584A

United States Patent [19]

Meagher et al.

[11] Patent Number: 5,165,584

[45] Date of Patent: Nov. 24, 1992

[54] ARCHER'S BOW AND CARRYING DEVICE

[76] Inventors: James F. Meagher, 180 Laban St., Providence, R.I. 02909; Gilbert A. Gauthier, 79 Main St., Blackstone, Mass. 01504

[21] Appl. No.: 672,138

[22] Filed: Aug. 27, 1990

Related U.S. Application Data

[63] Continuation-in-part of Ser. No. 309,812, Feb. 13, 1989, abandoned.

[51] Int. Cl.[5] ..... A45F 3/14

[52] U.S. Cl. ..... 224/258; 224/916; 224/901; 124/88

[58] Field of Search ..... 224/916, 257, 258, 202, 224/264, 205, 206, 150, 149, 913, 901; 124/88, 89, 90, 91

[56] References Cited

U.S. PATENT DOCUMENTS

| | | | |
|---|---|---|---|
| 609,317 | 8/1898 | Zimmerman | 224/231 |
| 1,631,694 | 6/1927 | Rick | 224/264 |
| 2,812,123 | 11/1957 | Girton | 224/150 |
| 3,920,166 | 11/1975 | Hogensen, Jr. | 224/205 |
| 3,998,367 | 12/1976 | Harding | 224/916 |
| 4,103,807 | 8/1978 | Lyon et al. | 224/916 |
| 4,760,944 | 8/1988 | Hughes | 224/916 |

*Primary Examiner*—Linda J. Sholl

[57] ABSTRACT

A bow carrying device which is adapted to be worn on the body of an archer and used to carry the archer's bow adjacent the body in a hands free manner includes a first strap assembly and a second strap assembly. The first strap assembly is adapted to be removably mounted at one end on the bow frame. The second strap assembly is adapted to be anchored by a loop formed at one end on a shoulder of the archer, extend around the top of the back of the archer and then extend down on the front of the archer on the side opposite the shoulder to which it is anchored. Complementary portions of a quick release fastener are mounted on each one of the strap assemblies so that the bow can be easily detached from the second strap member when desired. The bow need not be detached from the second strap assembly to make a shot. The second strap assembly is adjustable in length and also in the size of the anchor loop so as to accommodate different sized archers.

2 Claims, 4 Drawing Sheets

ARCHER'S BOW AND CARRYING DEVICE

This application is a continuation-in-part, of application Ser. No. 309,812, filed Feb. 13, 1989 now abandoned.

BACKGROUND OF THE INVENTION

The present invention relates generally to sporting equipment accessories and more particularly to a sporting equipment accessory adapted to be worn on the body of an archer and used to carry the archer's bow adjacent to the body in a hands free manner.

Devices for use in assisting a bowhunter in carrying an archery bow as he travels in woods, forests and the like in search of game are well known in the art.

For example, in U.S. Pat. No. 3,998,367 to J. F. Harding there is shown an adjustable strap harness for carrying an archery bow on the back of a person. The harness is attached to the bow at one end through a ring clip that is screwed onto the bow, is attached at the other end to the bow by a retainer hook and is attached at an intermediate portion to a belt worn around the waist of the user. When the harness is on the archer and the bow is attached, the bow is behind the archer's body. To bring the bow into shooting position, the user must release the retaining hook from the bow and then bring the bow over the shoulder to the front of the body.

As another example, in U.S. Pat. No. 3,168,971 to W. Goertzen there is disclosed a bow holder which is intended to be attached to a belt worn around the waist of the user and which conforms to the contour of the hip or waist so as to be comfortable when in use. The bow holder is an integrally formed generally U shaped plate member made of a plastic such as polystyrene. To bring the bow into shooting position, the user must remove the bow from the bow holder.

On page 31 of the Oct. 18, 1988 issue of Aqua-Fields Bowhunting Guide there is shown and described a device referred to as a compound bow sling. The device includes an elongated adjustable strap. A pair of Velcro fastener members wrap around the bow limb, one at each end of the bow handle and snap onto the ends of the adjustable strap. In use, the strap is slung over the shoulder of the wearer and attached to the bow with the bow string disposed below the bow frame. Since the bow string is lower than the bow frame, an arrow if mounted thereon will be pointed upward toward the head or neck of the user.

On page 155 of a Lew Horton's Sporting Goods Catalog, 1988 edition are a number of accessories for archers, including an item labelled A and referred to as a spare bow arm, which is a device which fits on a belt and carries a bow with a slight, stabilizer and quiver, an item labelled B and referred to as a bow sling, which is a device for securing a bow to the hand of an archer, another similar item labelled C referred to as an archery bow sling, an item labelled D referred to as a nylon bow sling, a sling type device which is attached to a compound bow by supplementary hardware and the compound bow sling referred to above and labelled E.

It is an object of this invention to provide a new and improved archer's bow carrying and shooting device.

It is another object of this invention to provide a bow carrying device which is adapted to be worn on the body of an archer and used to carry the archer's bow adjacent the body in a hands free manner.

It is still another object of this invention to provide a bow carrying device as described above in which the bow does not have to be detached therefrom in order to make a shot.

It is yet still another object of this invention to provide a bow carrying device as described above which can be used with all types of bows.

It is a further object of this invention to provide a bow carrying device as described above which can be used with left and right handed bows.

It is another object of this invention to provide a bow carrying device as described above which can be mounted on the bow without the use of supplementary hardware.

It is still another object of this invention to provide a bow carrying device as described above which supports a bow with the bow string above the bow frame.

It is yet still another object of this invention to provide a bow carrying device as described above in which the bow can be very quickly brought into position for firing.

It is a further object of this invention to provide a bow carrying device which is not intended to be mounted on a waist belt of a user.

It is still a further object of this invention to provide a bow carrying device which has a minimum number of parts, is easy and economical to manufacture and easy to use.

It is a further object to allow an archer to shoot an arrow with the assistance of the sling without detachment of the sling.

SUMMARY OF THE INVENTION

A bow carrying and shooting device which is adapted to be worn on the body of an archer and used to carry the archer's bow adjacent the body in a hands free manner constructed according to the teachings of the present invention includes a first strap and a second strap. The first strap is adapted to be removably mounted at one end on the bow frame. The second strap is adapted to be anchored at one end on a shoulder of the archer, extend around the top of the back of the archer and then extend down on the front of the archer on the side opposite the shoulder to which it is anchored. Complementary portions of a quick release fastener are mounted on each one of the straps so that the bow can be easily detached from the second strap when desired. The bow need not be detached from the second strap to make a shot. The second strap member is adjustable so as to accommodate different sized archers. The device can be used with either left or right handed archers and can be used with all types of bows. The device can include an additional third strap for further retention of the first strap on the bow.

Various objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

Figure 1:
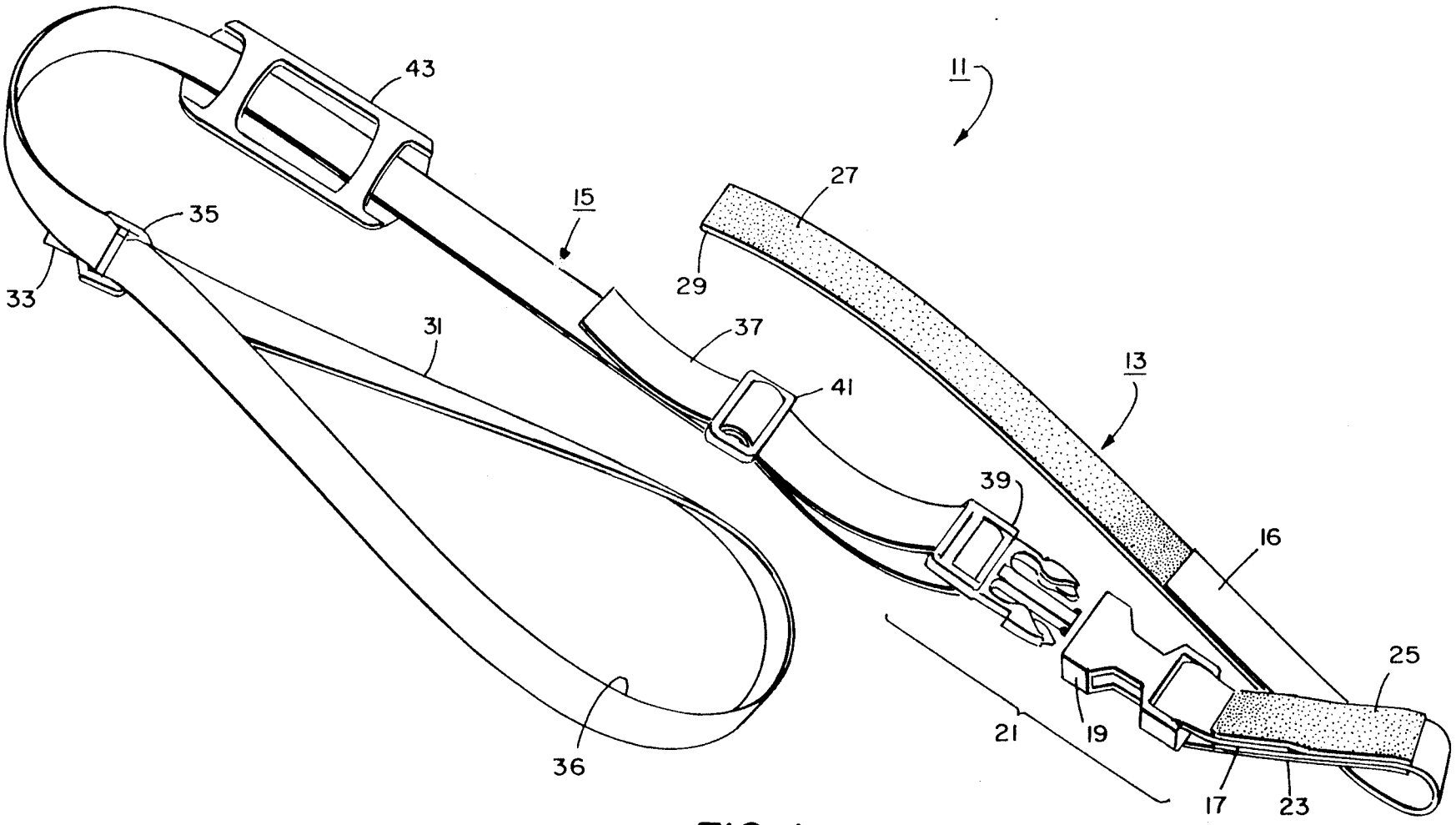
FIG. 1 is a perspective view of a bow carrying device constructed according to the teachings of the present invention with the first strap detached from the second strap.

Referring now to the drawings, there is shown in FIG. 1 a perspective view of a bow carrying and shooting device constructed according to the teachings of the present invention and identified by reference numeral 11.

Bow carrying device 11 comprises a first strap assembly 13 and a second strap assembly 15.

First strap assembly 13 includes first strap 16 which is preferably stretchable. Strap 16 may be made of a suitable fabric or plastic. An example of such a material is polypropylene. One end 17 of strap 16 doubles back on itself through the female part 19 of a quick release buckle 21 and is sewn in place. A strip 23 of Velcro hooks is sewn onto one side of strap 16 at the end containing female part 19 and another strip 25 of Velcro hooks is sewn onto the other side of strap 16 at the same end. A strip 27 of Velcro loops is sewn onto one side of strap 16 at the unattached other end 29. Strap 16, when assembled as shown, is preferably about 18 to 22 inches long.

Second strap assembly 15 includes a second strap 31 which is made of a sturdy fabric, or leather or plastic or the like. One end 33 of strap 31 is twisted once and then doubled back over itself through an adjustable buckle 35 to form a shoulder receiving anchor loop 36. The other end 37 of strap 31 goes through the male part 39 of quick release buckle 21 and doubles back over itself through another adjustable buckle 41. Strap material may be for example about 60 to 70 inches long. A shoulder pad 43 is slidably mounted on strap material 31 between adjustable buckles 35 and 41.

Quick release buckle 21 may be for example a Fastex #SRI buckle made by Nexus Corp. of Wood Dale, Ill.

In using bow carrying device 11, first strap assembly 13 is attached to the bow to be carried and second strap assembly 15 is mounted on the archer. The two strap assemblies are then attached to each other with the quick release buckle 21.

Figure 2:
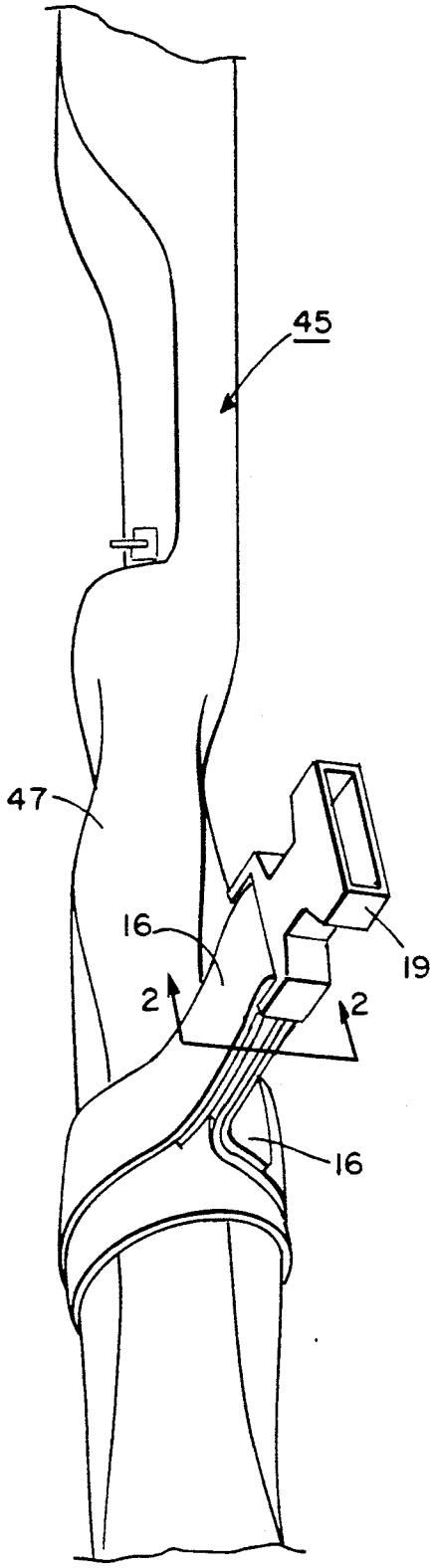
FIG. 2 is a perspective view showing how the first strap in the bow carrying device in FIG. 1 is mounted on an archery bow.
Figure 2A:
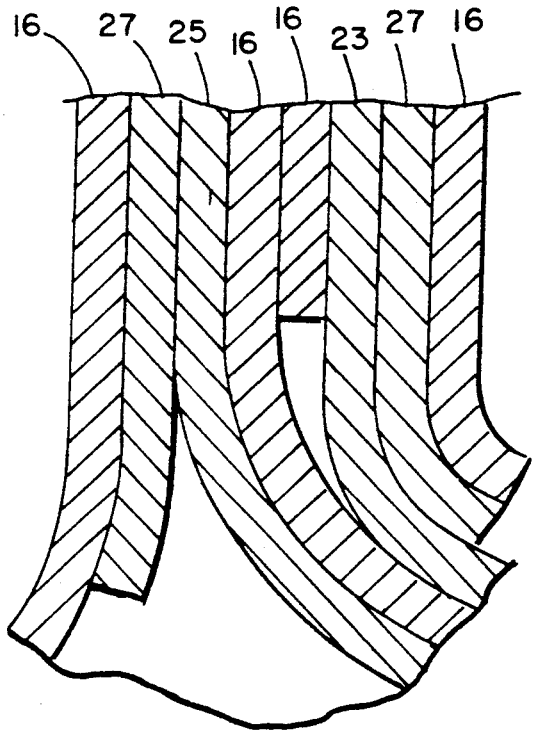
FIG. 2A is a section view taken along line 2—2 in FIG. 1.
Figure 3:
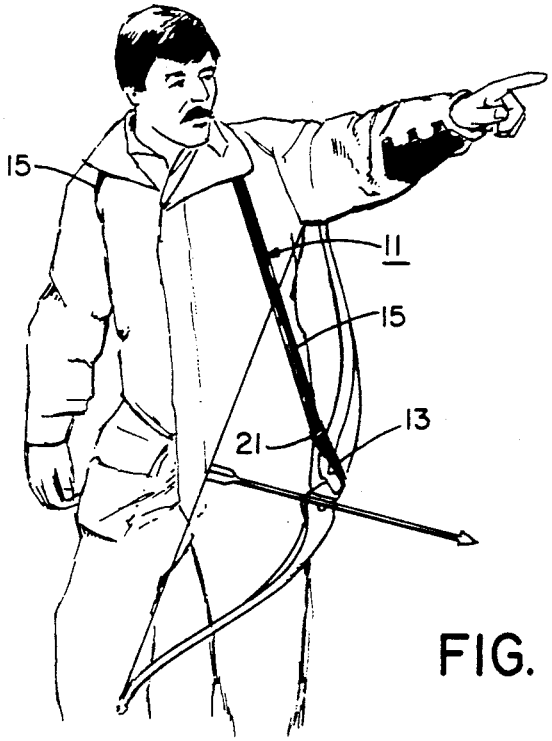
FIG. 3 is a perspective view from the front showing the bow carrying device mounted on an archer with the archery bow attached thereto.

In FIG. 2 there is shown how first strap assembly 13 is attached to a bow 45. For illustrative purposes only, the bow shown is a right handed bow for a right handed archer and the bow is a recurved type of bow. In FIG. 3 there is shown a view from the front of how device 11 is used by an archer to carry bow 45 and in FIG. 4 there is shown a view from the rear, illustrating how an archer can make a shot without detaching bow 45 from device 11.

As can be seen in FIG. 2, in attaching first strap assembly 13 to bow 45, first strap 16 is wrapped around bow 45 a few times just below the handgrip area 47 and pulled tight such that part 19 extends out in the direction of bow string 49. End 29 is then pulled through female part 19 of buckle 21 and secured to both sides of end 29 to end 17 by means of the Velcro strips. Because of the doubled sided attachment, part 19 will extend out rigidly and perpendicularly from bow 45.

In mounting second strap assembly 15 on the archer, the right arm of the archer is inserted into loop 36 and loop 36 pulled up tight at the under-arm and shoulder. Buckle 35 is then adjusted so as to anchor assembly 15 at the shoulder. Assembly 15 is then brought around the upper back area (just below the neck) and dropped over the chest area on the left side.

The two parts of buckle 25 are then connected. Finally, buckle 41 is adjusted so that bow 43 is at the desired position.

Figure 4:
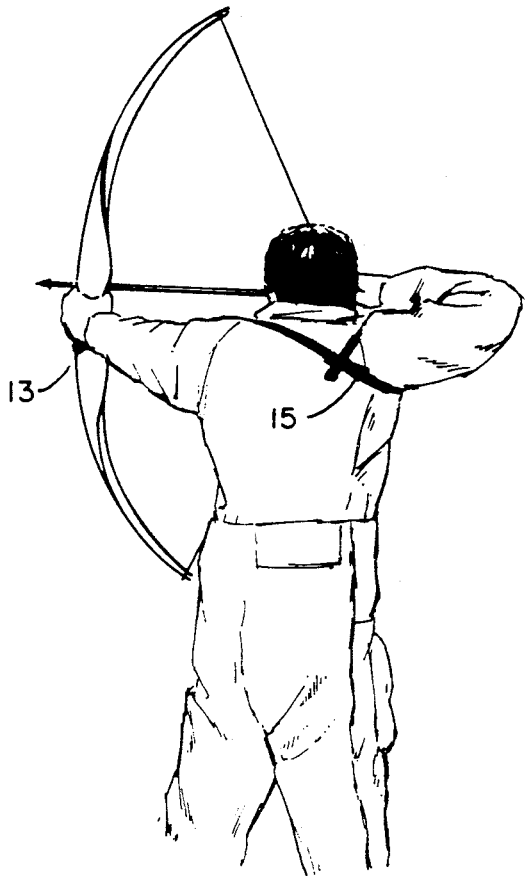
FIG. 4 is a perspective view from the back showing an archer wearing the bow carrying device, with the archery bow attached to the bow carrying device and in position for firing an arrow.

Device 11 has a number of advantages and features which render it superior to prior art bow carrying devices. For example, as can be seen in FIG. 4, when the device is mounted on an archer and a bow attached thereto, the bow string is above the bow frame. The device may also assist in steadying the bow when shooting as shown in FIG. 4. Consequently, if an arrow is mounted on the bow the tip will be facing downward away from the wearer's head or neck. This is extremely important from a safety standpoint. As is also apparent, the device does not require any supplementary hardware which must be attached to the bow. Also, the device is not limited to any particular type of bow and is useable with either left or right handed bows. Also, when a bow is attached, it is suspended at a location where it can be very easily and very quickly brought into position for firing. Also the bow need not be detached from the device to make a shot and will not interfere with the archer in making a shot. Also, the bow can be detached from the main part of the device that is mounted on the archer very easily and quickly.

Figure 5:
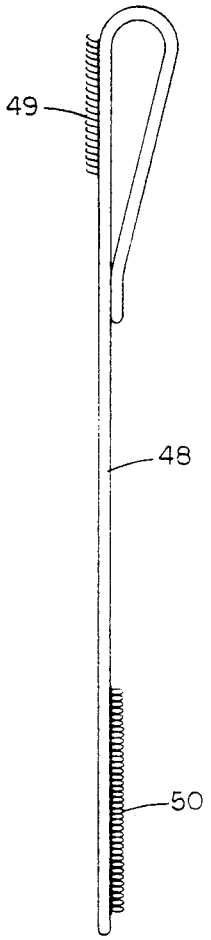
FIG. 5 is a side view of a third strap of the device.
Figure 6:
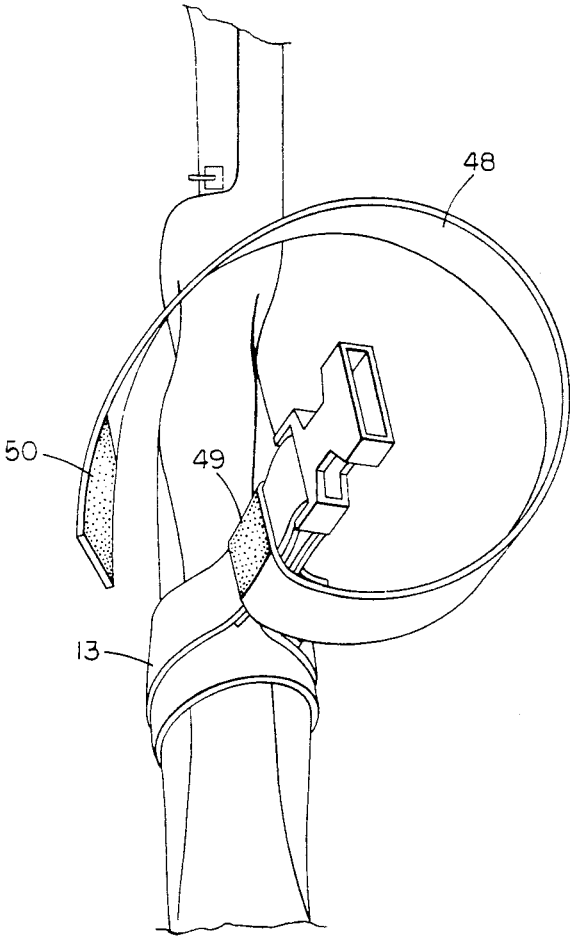
FIG. 6 is a perspective view of the device showing the third strap as it is secured around the first strap.
Figure 7:
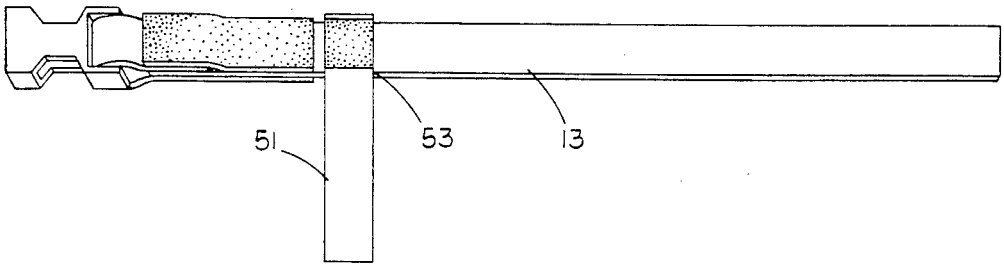
FIG. 7 is a top view showing the third strap attached to the first strap before the device is attached to the bow.

FIGS. 5, 6, and 7 show a third strap 51 to be utilized with the first strap 16 for further securement of the first strap 16 around the bow. The third strap 51 is formed from a strip of flexible material with a loop formed at one end. At the opposite end of the strap from the loop is one of a piece of loop or hook fastening material. On the opposite side of the strap and on the end with the loop is the other of a piece of loop or hook fastening material 49. As seen in FIG. 7, the third strap 51 is attached by sliding the first strap 13 through the loop. The first strap 13 is then attached to the bow in the same manner as it was without the third strap 51. Then as seen in FIG. 6, the third strap 51 is secured around the mated Velcro hooks and loops 23, 25, and 27 of the first strap 13 by the hook and loop fasteners 49, 50. The strap 51 is preferably 7.50 to 7.75 inches in length while the loop is constructed approximately 3.25 inches from the opposite end of the third strap 51.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A bow carrying and shooting device for use in carrying and shooting an archers bow adjacent the body of an archer in a hands free manner, the bow carrying and shooting device comprising:

a first strap having a first end and a second end:

a second strap having a first end and a second end:

the first ends of the first strap and second strap having connecting means for connecting the first strap and second strap together;

the first strap having first and second securing members; the first and second securing members being one of a strip of hook or loop fasteners; the first and second securing members being attached on opposite sides of the first end of the first strap adjacent to the connecting means of the first strap;

the first strap having a third securing member; the third securing member being the other of a strip of hook or loop fasteners attached to a side of the first strap at said second end; said second end of said second strap being formed in a loop sized to accommodate a shoulder of the archer;

whereby the first strap is wrapped around the bow such that the first strap is secured around the bow by the third securing member engaging both the first and second securing members.

2. The bow carrying and shooting device of claim 1 further comprising;

a third strap having a first end and a second end; said first end of said third strap having means for sliding over the first strap when the first strap is wrapped around the bow;

the third strap capable of being wrapped around the first strap and having loop and hook fasteners for retaining a wrapped position.

* * * * *